United States Patent [19]

Wright

[11] 4,191,560

[45] Mar. 4, 1980

[54] METHOD OF EXTRACTING A METAL FROM A MELT CONTAINING THE METAL

[75] Inventor: Peter A. Wright, Oxford, England

[73] Assignee: Gulf Chemical & Metallurgical Co., Texas City, Tex.

[21] Appl. No.: 959,018

[22] Filed: Nov. 9, 1978

[51] Int. Cl.[2] ..... C22B 25/00

[52] U.S. Cl. ..... 75/85; 75/24; 423/96; 423/561R

[58] Field of Search ..... 75/85, 24; 423/561, 423/96

[56] References Cited

U.S. PATENT DOCUMENTS

| | | | |
|---|---|---|---|
| 2,261,559 | 11/1941 | Osborn | 75/85 |
| 2,304,197 | 12/1942 | Osborn | 75/85 |
| 3,941,587 | 3/1976 | Queneau et al. | 75/72 |

FOREIGN PATENT DOCUMENTS

| | | | |
|---|---|---|---|
| 423166 | 4/1972 | Australia . | |
| 1224059 | 3/1971 | United Kingdom | 75/85 |
| 1344076 | 1/1974 | United Kingdom | 423/561 R |

*Primary Examiner*—M. J. Andrews

*Attorney, Agent, or Firm*—Christie, Parker & Hale

[57] ABSTRACT

A method for the production of gaseous sulphur from sulphur dioxide by means of a thermally balanced mixture which comprises a mixture of sulphur dioxide with air or oxygen and a gaseous or liquid hydrocarbon, the proportions of the components of such a mixture being so adjusted as to conform to the conditions that the gaseous reaction products from such a mixture shall have a minimum temperature determined by the liquidus temperature of the melt into which such reaction products are to be injected or the liquidus temperature of the products of reaction between the components of the melt and the injected gaseous reaction products, whichever is the greater, and that the partial pressure of oxygen in such gaseous reaction products is in accord with the desired composition of the melt.

6 Claims, No Drawings

METHOD OF EXTRACTING A METAL FROM A MELT CONTAINING THE METAL

This invention relates to a method of extracting a metal from a melt containing a metal, in particular by utilizing the conversion of sulphur dioxide to gaseous sulphur by means of thermally balanced mixtures, and more particularly to the introduction of sulphur into a molten slag, metal, matte, speiss or alloy by the injection into the melt of a mixture of sulphur dioxide, a hydrocarbon and air or oxygen.

The technique of burning a mixture of a fuel with air or oxygen beneath the surface of a liquid is well known and is termed submerged combustion. This invention is therefore concerned with the production of gaseous sulphur by means of the technique of submerged combustion.

It is well known that the temperature and composition of the gas in a flame are not uniform and that the variations in temperature and composition within a flame containing sulphur compounds are of critical importance to the formation of gaseous sulphur. In addition, factors other than the ultimate equilibrium state of the reaction:

$$2SO_2+4CO=S_{2(g)}+4CO_2 \quad (1)$$

may be taken into account and allowed for.

The object of introducing sulphur into a melt may be either to form a separate sulphide phase (matte) in which certain components of the original melt are concentrated, or to promote the formation of volatile sulphides which escape leaving the melt depleted of some of its original components.

An example of the desire to form a separate matte phase is described in U.S. Pat. No. 3,941,587 where it is proposed to recover a low grade copper matte from an iron-bearing copper slag by upward injection of a carbonaceous fuel, sulphur dioxide and oxygen in amounts sufficient to create strong reducing conditions and controlled turbulence in the slag. Reactions between solid carbon and the components of the slag play a major role in this process.

Examples of the desired formation of volatile sulphides are provided in the following operations:

(i) various processes for the recovery of tin from tin-bearing materials;

(ii) the elimination of certain impurities during the conversion of copper matte;

(iii) the use of a fuming furnace for the recovery of tin or bismuth.

There are a number of proposals for the recovery of tin from slags, ores, concentrates and other tin bearing materials by melting the tin-bearing material with a source of sulphur, fluxes, carbon and other reagents in order to promote the formation of volatile stannous sulphide which is recovered from the exhaust gases by various means.

A carrier gas is not used to entrain the gaseous products from these processes and reliance is placed on the attainment of a high temperature (1300°–1500° C.) to secure adequate volatilization of the tin content of the starting material; such processes thus require a high energy input in relation to the weight of tin recovered. Examples of such processes are described in Canadian Pat. No. 928,509 and British Pat. Nos. 1,188,080, 1,348,278 and 1,337,270.

In British Pat. No. 1,337,270 it is proposed that the melting be carried out in a cyclone furnace, thus providing an adequate supply of entrainment gas but greatly reducing the time available for volatilization of stannous sulphide.

In the well known process for the conversion of copper matte to blister copper by the injection of air into the molten matte, small quantities of impurities such as tin, bismuth, antimony and arsenic are volatilized from the melt, thus diminishing the proportion of the impurities in relation to the copper content of the blister copper so produced.

However, if the initial concentration of any of the above named impurities rises above a certain limit it is necessary to raise the ferrous sulphide content of the initial matte and hence lower the matte grade in order to secure the elimination of a greater proportion of the impurities during the conversion process.

This method of working gives rise to increased proportions of converter slag which must be reprocessed in order to recover the copper content thereof.

Now it is known from Australian Pat. No. 24659/71 that when the conversion of copper matte is carried out in a top-blown rotary converter in which the reactant gas is passed into the reaction vessel through a lance above the surface of the melt, then improved elimination of bismuth may be achieved by the introduction of a gas containing sulphur dioxide, a hydrocarbon and an appropriate proportion of oxygen. This gas mixture produces above the melt an atmosphere containing gaseous sulphur and this atmosphere assists the elimination of bismuth, although the conversion of copper matte to blister copper is halted while such an atmosphere is maintained.

The first application of a fuming process to the recovery of tin from slags is described in U.S. Pat. Nos. 2,261,559 and 2,304,197. In this, the Phelps-Dodge process, molten tin-bearing slag was charged to a Pierce-Smith converter fitted with special tuyeres each of which consisted of three concentric pipes through which pyrites, fuel oil and air were separately introduced and the resultant mixture was injected below the surface of the slag.

The submerged combustion of the fuel with insufficient air for complete combustion of the fuel together with the presence of pyrites generated heat, turbulence in the slag and the sulphur or sulphide necessary for the formation of stannous sulphide by reactions which may be written:

$$SnO_{(slag)}+FeS=SnS_{(gas)}+FeO_{(slag)} \quad (2)$$

or $$2SnO_{(slag)}+3/2\ S_{2(gas)}=2SnS_{(gas)}+SO_2 \quad (3)$$

Between the mouth of the converter and the gas duct above the mouth a further admission of air completed the oxidation of the tuyere combustion products and also converted the gaseous stannous sulphide to solid stannic oxide in the form of fine particles according to the reaction:

$$SnS_{(gas)}+2O_2=SnO_{2(solid)}+SO_2 \quad (4)$$

The exhaust gas in the duct was drawn through suitable filters in order to recover the particulate stannic oxide.

Problems encountered in this process were the blocking of the tuyeres and rapid erosion of the refractory lining of the converter vessel and the foregoing procedure has been replaced by the use of a fuming furnace.

The important difference between the Phelps-Dodge process and the fuming process is that in the fuming process the source of sulphur is not introduced through the same tuyeres as is the mixture of fuel and oxidant but is introduced either through separate tuyeres or is charged directly into the molten slag bath through suitable charging ports situated above the surface of the slag bath.

The structure of the fuming furnace used in these operations is similar to the well known lead-zinc slag fuming furnace. The difference between the chemical processes of sulphide fuming and of lead-zinc slag fuming has been explained by Kellogg, "Vaporization Chemistry in Extractive metallurgy", the 1966 extractive metallurgy lecture, Trans. Met. Soc. AIME 236, p. 602 (1966), and emphasized by Wright, "Tin Volatilization and its Influence on the Smelting and Mining of tin", fourth world conference on tin, I.T.C. 1974.

The recovery of tin or bismuth from their sulphide ores by the use of a fuming furnace is described in British Pat. No. 1,391,572.

Now in its present form the sulphide fuming process suffers from the following disadvantages:

(a) It is found that it is necessary to provide a considerably greater proportion of sulphur bearing material than that corresponding to the formation of the desired metallic sulphide the function of the excess sulphur or sulphide being to reduce magnetite, $Fe_3O_4$, which is formed by reaction between the gaseous combustion products and the iron content of the slag which is being treated.

The use of pyrites as the source of sulphur increases the iron content of the slag and consequently aggravates the tendency to magnetite formation as the process proceeds.

(b) Pyrites generally contains volatile impurities such as arsenic and lead and these impurities contaminate the desired product. This contamination of the product is particularly undesirable when the material being treated is a tin bearing slag since such slags are rarely impure with respect to volatile impurities.

(c) The two previous problems may be mitigated by the use of substances other than pyrites as the source of sulphur but the problem of introducing a solid substance into a fluid remains.

(d) The exhaust gas from processes based on the volatilization of sulphides contains sulphur dioxide and such a process must bear the cost of either a chimney stack of sufficient height to avoid local pollution of the environment, or a plant for the removal of sulphur dioxide from the exhaust gas together with cost of disposal of the sulphur bearing product from the plant.

Now it is argued that if sulphur dioxide can be used as the source of sulphur in the foregoing processes the disadvantages can be avoided or greatly reduced, and the present invention is concerned with the manner in which sulphur dioxide may be used as the prime source of sulphur to be injected into the bath of molten material.

The use of sulphur dioxide as the prime source of sulphur in the sulphide fuming of tin provides examples of the two constraints governing the production of a sulphur-bearing gas from sulphur dioxide by means of submerged combustion.

The first constraint is produced by the adverse effect of rising temperature on the equilibrium of the reaction:

$$2SO_2+4CO=S_{2(gas)}+4CO_2 \quad (1)$$

The second constraint is due to the low heat effect in the oxidation of hydrocarbons by sulphur dioxide.

These constraints are now discussed quantitively and it will be demonstrated that the efficient production of sulphur-bearing gas by the technique of submerged combustion may be attained.

The state of oxidation of a system is chemically defined by the partial pressure of oxygen in a gas which is in equilibrium with the system, and in a gas containing the oxides of carbon the partial pressure of oxygen may be related to the ratio $pCO_2/pCO$ in which $pCO_2$ and pCO are respectively the partial pressures of carbon dioxide and carbon monoxide present in the gas.

Since it is particularly convenient to discuss the combustion products from mixtures of hydrocarbons with air or oxygen in terms of the ratio $pCO_2/pCO$ this parameter will be used and will be denoted by the symbol R.

Now a first observation is that the flame temperature attained in the combustion of mixtures of hydrocarbons with air lies between 2000° C. and 2100° C. irrespective of the value of R over a very wide range of values of R.

This observation coupled with the equilibrium data for reaction (1) shows that it is not practicable to use a single source for the simultaneous production of both heat and a sulphur-bearing gas because the flame temperature is such that the proportion of sulphur dioxide converted to gaseous sulphur would be less than 1%. It is therefore necessary to consider the production of a sulphur-bearing gas as a process apart from the process of heating the melt.

Now in the specific process for the production of a sulphur-bearing gas there are three factors to be considered:

(i) limitations imposed on R by the desired composition of the melt;

(ii) the maximum temperature of the system;

(iii) the minimum temperature which must be attained in the injected gas stream.

(i) Limitation on R imposed by the desired composition of the melt.

The sulphide fuming of tin requires R to be limited to a narrow range $2.5<R<4.5$ in order to maintain the tin content of the slag in the stannous state by virtue of the competing reactions:

$$SnO_2+CO=SnO_{(slag)}+CO_2 \quad (5)$$

$$SnL30\ CO_2=SnO_{(slag)}+CO \quad (6)$$

This is an unusually severe limitation on R and in general it is to be expected that R will be restricted to values below a stated figure.

(ii) The maximum temperature of the System.

This temperature will not differ greatly from the temperature of the melt into which the gas stream is injected but the temperature within the gas bubbles passing through the melt may be expected to be lower than the temperature of the melt when volatile sulphides are to be produced and greater than the average melt temperature when a separate matte phase is to be produced.

Since it is the maximum temperature which is operative this maximum may be assumed to be 100° C. above the average temperature of the melt in the absence of other evidence.

Now the maximum temperature of the gas stream determines, by virtue of the equilibrium obtaining in reaction (1), either the proportion of sulphur dioxide which is converted to gaseous sulphur in a specified mixture of sulphur dioxide with a hydrocarbon, or the composition of the mixture of sulphur dioxide with a hydrocarbon which will yield a specified proportionate conversion of sulphur dioxide to gaseous sulphur.

(iii) The minimum temperature which must be attained in the injected gas stream.

Since the gaseous reaction products of the mixture of sulphur dioxide with a hydrocarbon are to be injected into a melt it is clear that in order to avoid blockage of the injection nozzle by solid substances frozen out from the melt, the temperature of the gaseous reaction products must be equal to the liquidus temperature either of the melt or of the products of the reaction between the melt and the injected gas stream, whichever of these two temperatures is the greater. This minimum temperature of the gaseous reaction products must be attained by the heat of the reaction or reactions which produce the reaction products from the initial mixture of sulphur dioxide with a hydrocarbon.

The minimum temperature will generally lie in the range 900° C. to 1300° C. A second observation is that having specified R and the maximum temperature, the composition of the mixture of sulphur dioxide with a hydrocarbon is fixed and that the temperature which is attained in the reaction products from this mixture of fixed composition is below the temperature required in order to ensure freedom from freezing out of solid substances from the melt.

A third observation is that it is possible to add to the mixture of sulphur dioxide and hydrocarbon a further mixture of air or oxygen and hydrocarbon in such proportion and of such composition that the required minimum temperature of the gaseous reaction products is attained and that the required value of R and proportionate conversion of sulphur dioxide to gaseous sulphur are maintained. The resultant mixture of sulphur dioxide, air or oxygen and hydrocarbon is termed a Thermally Balanced Mixture for the purposes of this specification.

The present invention provides a method of extracting a metal from a melt containing the metal, wherein a thermally balanced mixture which comprises a mixture of sulphur dioxide with air or oxygen and a gaseous or liquid hydrocarbon is injected into the melt of the metal to form a sulphide of the metal, the said melt being capable of reacting with gaseous sulphur produced from the sulphur dioxide to form a said sulphide, and the proportions of the components of the said thermally balanced mixture being such that the gaseous reaction products from such a mixture shall have a minimum temperature determined by the liquidus temperature of the melt into which such reaction products are to be injected or the liquidus temperature of the products of reaction between the components of the melt and the injected gaseous reaction products, whichever is the greater, and that the partial pressure of oxygen in such gaseous reaction products is in accord with the desired composition of the melt.

The thermally balanced mixture may be injected into a melt to increase the sulphur content of the melt, to produce a separate sulphide phase from the melt, or to promote the formation of volatile sulphides which will be removed from the melt.

The thermally balanced mixture may be generated from sulphur dioxide which has been recovered from exhaust gases.

The method according to the invention may be applied to the recovery of the tin from slags, wherein the thermally balanced mixture is introduced into a slag bath through at least one tuyere or injection lance which is independent of the main furnace heating system.

When the invention is applied to the production of matte from slag a hydrocarbon fuel may possibly be used in place of the solid carbonaceous fuel which is employed in the process described in U.S. Pat. No. 3,941,587, so eliminating the need to introduce a solid reagent through the tuyere nozzle.

The advantage of the application of the invention to the conversion of copper matte is that a gas stream of high sulphur content may be injected into the melt thereby accelerating the volatilization of impurities and so reducing the time during which an atmosphere as referred to previously is maintained.

In order to test the validity of the concept of a thermally balanced mixture and to compare the results obtained by using such a mixture with the results obtained by using a well known procedure four tests were carried out on the sulphide fuming of tin slag since this operation imposes the most severe restrictions on a thermally balanced mixture.

In two of the tests the sulphur was provided by means of a thermally balanced mixture of sulphur dioxide, air and methane and in two further tests the sulphur was provided by the addition of pyrites.

The synthetic tin slag used in all four tests had the following weight percentage composition:

SnO 12=10.6 Sn
FeO 25=19.4 Fe
$Al_2O_3$ 12
$SiO_2$ 40
CaO 11

The parameters used in the calculation of the thermally balanced mixture were:

R=3, maximum temperature 1300° C., minimum temperature 1200° C., and the volume percentage of the mixture was:

$SO_2$ 25
air 55
$CH_4$ 20 with a conversion of sulphur dioxide to gaseous sulphur of 85% at 1300° C.

In each test 400 g of slag was melted in an alumina crucible held in a graphite susceptor inside a silica tube and heating of the susceptor was by means of a high frequency induction furnace; the temperature of the slag was held at 1300° C.±7° C. in all four tests. A susceptor is an annular object made from a material, usually graphite, which is susceptible to being heated by a high frequency electric field and so by radiation in turn heating the crucible inside the susceptor. The depth of liquid slag in the crucible was about 5 cm and the gas inlet tube was submerged to about 4 cm below the surface of the slag.

In tests 1 and 2 the thermally balanced mixture was passed through the molten slag at a rate of 600 $cm^3$/min. for a total of 120 mins after which the gas flow was stopped and the contents of the crucible were allowed to settle for 30 mins. at 1300° C. before the final slag samples were taken.

In tests 3 and 4 argon was passed through the molten slag at a rate of 600 $cm^3$/min. and when the slag temperature reached 1300° C. 6.5 g of pyrites was added to the melt through a tube which terminated just above the surface of the melt, and further additions of 6.5 g of pyrites were made at 20 min. intervals thereafter until a total of 39 g of pyrites had been added and the argon flow had been maintained for 120 mins; as in tests 1 and 2 a 30 min. settling time was allowed before slag samples were taken.

The weight of sulphur introduced in tests 1 and 2 is calculated as 85% of the sulphur content of the total sulphur dioxide or 21.3 g, and in tests 3 and 4 as 53% of the weight of the pyrites or 20.8 g.

The results of these tests are summarized in Table 1 where the following data are presented:

(a) initial weight of slag at 10.6% Sn ($Sn_o$), g.
(b) weight of pyrites added, g.
(c) % Sn in slag after 60 mins.
(d) % Sn after 120 min, ($Sn_t$)
(e) final weight of slag+matte after 120 mins. g.
(f) calculated weight of tin volatilized, g.
(g) equivalent sulphur content of tin volatilized as SnS, g
(h) weight of sulphur introduced, g.
(j) % of sulphur introduced which has formed SnS.
(k) the velocity constant for the reaction calculated from the expression:

$$k = \frac{1}{t} \log_e \frac{Sn_O}{Sn_t}$$

in which t is the reaction time in mins.

TABLE 1

| | Thermally balanced mixture | | Pyrites addition | |
|---|---|---|---|---|
| | Test 1 | Test 2 | Test 3 | Test 4 |
| (a) inntial weight of Slag at 10.6% Sn, g. | 398.3 | 398.2 | 395.5 | 389.8 |
| (b) weight of pyrites added, g. | — | — | 39.0 | 39.0 |
| (c) % Sn after 60 min. | 4.3 | — | 6.3 | 6.9 |
| (d) % Sn after 120min. | 1.85 | 1.63 | 2.73 | 3.24 |
| (e) final weight of slag + matte after 120 min.g. | 353.2 | 355.6 | 389.0 | 376.7 |
| (f) Sn volatilized, g. | 35.69 | 36.41 | 31.30 | 29.11 |
| (g) equivalent S, g. | 9.6 | 9.8 | 8.4 | 7.8 |
| (h) S in, g. | 21.3 | 21.3 | 20.8 | 20.8 |
| (j) *utilization of S, %. | 45.0 | 46.0 | 40.5 | 37.5 |
| (k) velocity constant | 0.0145 | 0.0156 | 0.0113 | 0.0099 |

*as calculated against the total sulphur content of the sulphur dioxide introduced (25.7g) in tests 1 and 2 the utilizations are 37.3% and 38.1% respectively.

These results may be compared with the data provided by Weigel and Zetsche on the performance of the tin fuming process used at the Vinto Smelter in Bolivia, "Vinto Tin Smelter—Unusual Methods to Smelt Difficult Ores", World Mining, July 1974, pp. 37–38.

temperature of slag charged to the furnace, 1250° C.
temperature of slag tapped from the furnace, 1300° C.
tin content of slag charged, 10.5%
tin content of slag tapped, 0.2%
time of treatment, 390 mins
pyrite addition, 25% of slag weight.

From these results are calculated a sulphur utilization of 22% and velocity constant of 0.0101 which is in close agreement with the results obtained in tests 3 and 4.

Comparison of the results obtained by the use of a thermally balanced mixture with those obtained by the use of pyrites confirm that sulphur dioxide may be used efficiently as a source of gaseous sulphur and that gaseous sulphur is an efficient sulphidizing agent.

A thermally balanced mixture may be based on the use of gas-oil in place of a gaseous hydrocarbon. It is also calculated that if the value of R, the ratio $pCO_2$/-pCO in the reaction products, is allowed to fall as low as 0.5, then a very high conversion of sulphur dioxide to gaseous sulphur may be attained at temperatures as high as 1500° C.

Amongst the advantages of the use of a thermally balanced mixture for the introduction of sulphur to a melt are the following:

(i) The need to feed a solid material into a fluid is eliminated.
(ii) Adventitious contaminants are not introduced.
(iii) The melt is not diluted by components of the sulphur-bearing material.
(iv) In the specific case of the sulphide fuming of tin the susceptibility of the process to the formation of magnetite is not increased.
(v) The environmental pollution due to the emission of exhaust gas containing sulphur dioxide may be eliminated at a low cost since the sulphur dioxide scrubbed out of the exhaust gas may be recycled to the process from which it is generated.

I claim:

1. A method of sulfidizing a metal in a melt of the metal comprising the steps of:

(a) mixing sulfur dioxide, air or oxygen, and a gaseous or liquid hydrocarbon in proportions so the gaseous reaction products of the mixture have a minimum temperature greater than the liquidus temperature of the melt or the liquidus temperature of the products of the reaction between the compounds of the melt and reaction products of the mixture, and so that the ratio of the partial pressure of carbon dioxide to the partial pressure of carbon monoxide in the reaction products of the mixture falls within a range of 2.5:1 and 4.5:1; and
(b) injecting the mixture into the melt to react the mixture components to generate heat and form a sulfide of the metal.

2. A method according to claim 1 which includes adding sufficient air or oxygen and gaseous or liquid hydrocarbon to the mixture so that the heat of combustion of the mixture reactants maintains the liquidus temperature of the melt.

3. A method according to claim 1 which includes the step of recovering the sulfur dioxide from exhaust gases and mixing the recovered sulfur dioxide with the other compound of the mixture.

4. A method according to claim 1 in which the metal is tin in a molten slag and which includes introducing the mixture into the molten slag through at least one tuyere or injecting lance, and independently heating the molten slag.

5. A method according to claim 1 in which the temperature of the reaction products of the gas mixture is about 100° C. above the temperature of the melt.

6. A method according to claim 1 in which the temperature of the reaction products is between about 900° C. and 1300° C.

* * * * *

UNITED STATES PATENT AND TRADEMARK OFFICE

CERTIFICATE OF CORRECTION

PATENT NO. : 4,191,560

DATED : March 4, 1980

INVENTOR(S) : PETER AMYAS WRIGHT

It is certified that error appears in the above-identified patent and that said Letters Patent are hereby corrected as shown below:

Col. 1, line 6, "a", second occurrence, should read --the--;
Col. 3, line 18, "metallurgy" should read --Metallurgy--;
line 22, "tin', fourth world conference on tin," should read --Tin", Fourth World Conference on Tin,--
line 40, "contains" should read --contain--
Col. 4, line 46, "$SnL30CO_2=SnO_{(slag)}+CO$" should read --$Sn+CO_2=SnO_{(slag)}+CO$--
Col. 8, line 8, "confirm" should read --confirms--

Signed and Sealed this

First Day of July 1980

[SEAL]

Attest:

SIDNEY A. DIAMOND

Attesting Officer

Commissioner of Patents and Trademarks